United States Patent [19]

Little et al.

[11] 4,244,638

[45] Jan. 13, 1981

[54] SNAP-IN STRAIN RELIEF

[75] Inventors: David M. Little, Harrisonburg, Va.; Brian A. Wolfe, Jonestown, Pa.

[73] Assignee: AMP Incorporated, Harrisburg, Pa.

[21] Appl. No.: 35,377

[22] Filed: May 3, 1979

[51] Int. Cl.[3] ..... H01R 13/58

[52] U.S. Cl. ..... 339/103 M; 24/16 PB; 140/93 A; 174/135; 339/59 M

[58] Field of Search ..... 339/103, 101, 59 M; 24/16 PB; 140/93 A; 174/135

[56] References Cited

U.S. PATENT DOCUMENTS

| | | | |
|---|---|---|---|
| 3,562,870 | 2/1971 | Sund | 24/16 |
| 3,671,921 | 6/1972 | Baker et al. | 339/103 M |
| 3,694,863 | 10/1972 | Wasserlein, Jr. | 24/16 |
| 3,830,263 | 8/1974 | Benfer | 140/93 A |
| 3,854,787 | 12/1974 | Snyder, Jr. | 339/103 R |
| 3,891,012 | 6/1975 | Bakermans | 140/93 A |
| 3,904,265 | 9/1975 | Hollyday et al. | 339/103 M |
| 4,080,035 | 3/1978 | Clark et al. | 339/103 M |
| 4,111,512 | 9/1978 | Parmer et al. | 339/103 M X |
| 4,160,575 | 7/1979 | Schraut | 339/103 M |

*Primary Examiner*—John McQuade
*Assistant Examiner*—DeWalden W. Jones
*Attorney, Agent, or Firm*—Russell J. Egan

[57] ABSTRACT

A strain relief member is disclosed for selective and removable mounting in a connector housing. The strain relief member includes means to receive a bundle tie for securing conductors to the strain relief member. The connector housing includes an elongated, centrally disposed slot which receives the strain relief member therein.

6 Claims, 3 Drawing Figures

SNAP-IN STRAIN RELIEF

BACKGROUND OF THE INVENTION

1. The Field of the Invention

The present invention relates to an improved strain relief for electrical connectors and in particular to a strain relief member which can be snapped into place in a centrally disposed, elongated slot in an electrical connector housing.

2. The Prior Art

The previously utilized strain relief members have generally been of two types. The first is a strain relief which forms an integral part of the housing as shown in U.S. Pat. No. 3,854,787. This can make the housing quite cumbersome and bulky as well as expensive for instances when a strain relief is not necessary. The second type of strain relief is one which is added to an existing housing. Most of these are either permanently fixed to the housing, for example as shown by U.S. Pat. No. 4,080,035 or detachably secured to a housing as shown by U.S. Pat. Nos. 3,671,921 and 3,904,265.

SUMMARY OF THE INVENTION

The present invention is intended to overcome the deficiencies of the prior art by providing an electrical connector strain relief member to be used in combination with an electrical connector housing having two parallel spaced terminal carrying portions defining at least one elongated slot therebetween. The strain relief member itself is formed of a plate of rigid material having an overall rectangular profile with an integral pair of legs extending from one side thereof. Each leg has a free end adapted for mating in the connector in a latching engagement and a patterned array of apertures or notches for receiving a bundle tie to secure conductors of the connector to the strain relief member. The strain relief member can further include a profiled surface portion adapted to center the conductors.

It is therefore an object of the present invention to produce an improved strain relief member for electrical connectors which member can be detachably secured to the connector as necessary.

It is a further object of the present invention to produce a detachable strain relief member which can be readily and economically produced.

The means for accomplishing the foregoing objects and other advantages will be apparent to those skilled in the art from the following detailed description taken with reference to the accompanying drawings.

DETAILED DESCRIPTION OF THE PREFERRED EMBODIMENTS

Figure 1:
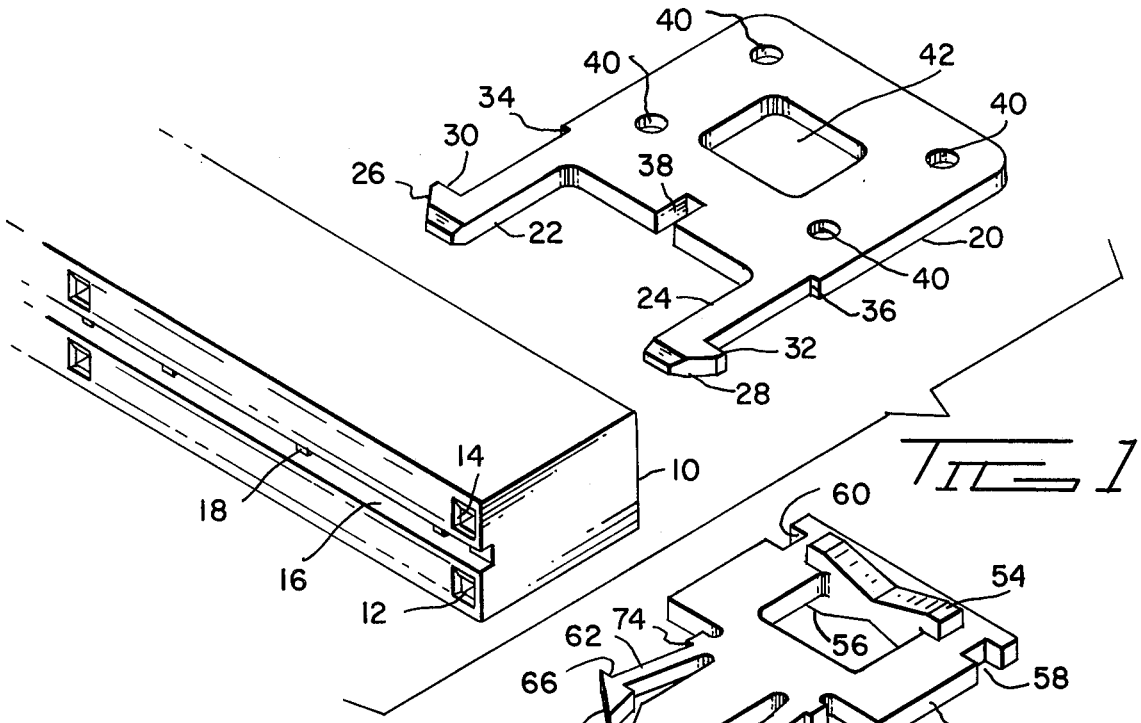
FIG. 1 is an exploded perspective view of a first embodiment of the subject strain relief and an electrical connector.

The subject invention is used in combination with an electrical connector 10 which has a housing of rigid insulative material forming at least two rows 12, 14 of connector terminal receptacles defining an elongated slot 16 between adjacent pairs of rows. The slot 16 is subdivided into a plurality of passages by integral bars or ribs 18 joining the rows together. The strain relief member 20 is formed from a planar piece of rigid plastics material and has an overall rectangular profile with a pair of integral legs 22, 24 extending from one side edge thereof. Each leg has a profiled free end with a forwardly directed slope 26, 28, a rearwardly directed shoulder 30, 32, and includes a notch or step 34, 36 where the legs join the body of the member. The side edge can be provided with a notch 38 as necessary if the member is to straddle one or more bars 18. The strain relief member is provided with a plurality of apertures 40 in a patterned array. The member can also be provided with a centrally disposed aperture 42.

The legs 22, 24 of the strain relief member 20 are slipped into the slot 16. The sloped surfaces 26, 28 engage bars 16 and drive the legs together allowing passage to the position shown in FIG. 2 with the shoulders 30, 32 engaging one end of the bars 18 while the shoulders 34, 36 engage the opposite end. A strain relief member of sufficient width to span more than one of the passages in the slot 16 is provided with a notch 38 which receives an intervening bar 18 therein.

Figure 2:
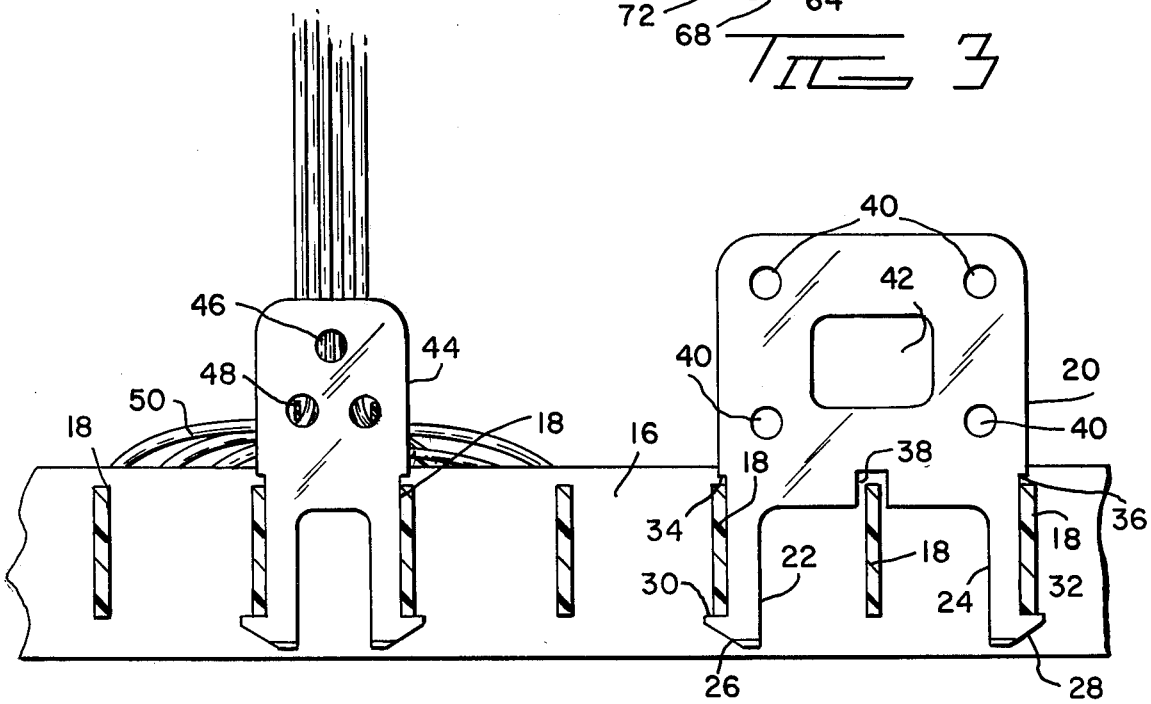
FIG. 2 is a transverse section view through the connector of FIG. 1 showing first and second alternate embodiments of the subject strain relief member mounted therein.

A smaller alternate embodiment of the strain relief member 44 is also shown in FIG. 2. The primary difference between the strain relief member 44 and the strain relief member 20 is one of dimensions and positioning of the apertures 40, 46 which receive a bundle tie 48 securing conductors 50 to the member.

It should be here noted that the bundle tie 48 is of any of the well known configurations, such as those described in U.S. Pat. Nos. 3,562,870 and 3,694,863, and applied by tools such as those described in U.S. Pat. Nos. 3,830,263 and 3,891,012, the disclosures of which are all incorporated herein by reference.

Figure 3:
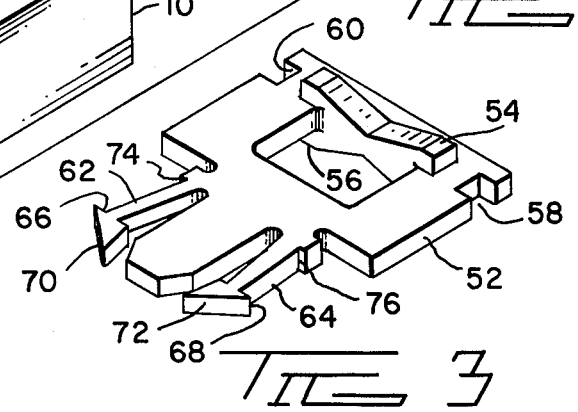
FIG. 3 is a perspective view of a further alternate embodiment of the subject strain relief.

Another alternate embodiment of the subject strain relief member is shown in FIG. 3. This strain relief member 52 has an overall rectangular profile with integral generally V-shaped projections 54, 56 aligned to extend from opposite surfaces thereof. Notches 58, 60 are formed in opposite edges of the member 52 in alignment with the ends of the projections 54, 56. The strain relief member 52 also has integral legs 62, 64 extending from one edge in opposition to the projections 54, 56. Each leg 62, 64 has a rearwardly directed shoulder 66, 68, formed by a forwardly directed incline 70, 72, and a rearwardly spaced shoulder 74, 76, respectively.

The embodiment of the strain relief member shown in FIG. 3 would be mounted on the connector in a similar fashion to the previously discussed embodiments. The only difference is in the manner in which the conductors would be secured to the strain relief member. For this embodiment the conductors (not shown) are placed in the notch of the projections 54, 56 and secured therein by passing a bundle tie (not shown) around the conductors and the strain relief member and engaging in the notches 58, 60.

The present invention may be subject to many modifications and changes without departing from the spirit or essential characteristics thereof. The present embodiments should be considered in all respects as illustrative and not restrictive of the scope of the invention.

What is claimed is:

1. In combination with an electrical connector housing having at least two parallel spaced terminal carrying portions defining at least one elongated slot between each adjacent pair of rows and a plurality of parallel spaced bars subdividing said slot into a plurality of passages, a strain relief member detachably secured to said connector, said strain relief member comprising:

a plate of rigid material having an overall rectangular plan profile, with an integral pair of legs extending from one side thereof and set in from corners thereof to form outwardly directed first shoulders adjacent the legs, each leg having a profiled free end including an outwardly and rearwardly directed slope forming a second outwardly and rearwardly directed shoulder spaced from the first shoulder and adapted to engage opposite ends of a respective bar in said slot; and a patterned array of apertures in said plate whereby said plate is attached to said connector housing and conductors are secured in said plate by tie down means passing through said apertures and around said conductors.

2. The strain relief member according to claim 1 wherein said legs are spaced apart a distance not greater than the spacing between adjacent bars of said housing.

3. The strain relief member according to claim 1 wherein said legs are spaced apart a distance substantially equal to the spacing between two bars of said housing and further comprising a notch in said one side adapted to receive therein bars spanned by said legs.

4. The strain relief member according to claim 1 further comprising a profiled extension on at least one surface of said member, said extension adapted to gather together conductors placed therein.

5. A strain relief member for selective and removable attachment to an electrical connector housing having at least one elongated slot therein, said strain relief member comprising:

a rigid plate of insulating material having a generally rectangular configuration with a patterned array of apertures therein;

bundle tie means passing through a spaced pair of said apertures and encircling a portion of said member and conductors positioned thereagainst; and a pair of integral legs extending from one side edge of said plate, each leg being stepped inwardly from a corner of said edge to define a first shoulder, the free end of each leg having an outwardly sloped surface defining an outwardly and rearwardly directed second shoulder spaced from said first shoulder, whereby said member is detachably secured in said connector by said legs with said shoulders engaging opposite sides of said housing at opposite ends of said slot.

6. In combination with an electrical connector housing having two parallel spaced terminal carrying portions defining at least one elongated slot therebetween a plurality of integral bars in parallel spaced relation dividing said slot into a plurality of equal passageways, a strain relief member detachably secured to said connector, said strain relief member comprising:

a plate of rigid material having an overall rectangular plan profile with an integral pair of legs extending from one side thereof, each leg being stepped inwardly from an adjacent corner to define a first shoulder and having a sloped free end defining an outwardly and rearwardly directed second shoulder, said legs being received in a passageway with said shoulders engaging opposite ends of a respective bar;

a patterned array of apertures in said plate; and bundle tie means passing through said apertures and around conductors and portions of said strain relief member to secure said conductors thereto.

* * * * *